US012222127B2

(12) United States Patent
Wei et al.

(10) Patent No.: US 12,222,127 B2
(45) Date of Patent: Feb. 11, 2025

(54) AIR CONDITIONER, CONTROL METHOD AND CONTROL DEVICE THEREOF

(71) Applicant: GREE ELECTRIC APPLIANCES, INC. OF ZHUHAI, Guangdong (CN)

(72) Inventors: Feng Wei, Zhuhai (CN); Haidong Lin, Zhuhai (CN); Si Sun, Zhuhai (CN); Chuanhua Wang, Zhuhai (CN); Enquan Zhang, Zhuhai (CN); Pengju Zhao, Zhuhai (CN); Pu Zhao, Zhuhai (CN); Huaben Li, Zhuhai (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 366 days.

(21) Appl. No.: 17/713,051

(22) Filed: Apr. 4, 2022

(65) Prior Publication Data

US 2022/0228767 A1 Jul. 21, 2022

Related U.S. Application Data

(63) Continuation-in-part of application No. 16/342,533, filed as application No. PCT/CN2017/103464 on Sep. 26, 2017, now abandoned.

(30) Foreign Application Priority Data

Oct. 17, 2016 (CN) ..... 201610903627.7

(51) Int. Cl.
*F24F 11/86* (2018.01)
*F24F 11/63* (2018.01)

(52) U.S. Cl.
CPC ..... *F24F 11/86* (2018.01); *F24F 11/63* (2018.01)

(58) Field of Classification Search
CPC ..... F24F 11/86; F24F 11/63
See application file for complete search history.

(56) References Cited

U.S. PATENT DOCUMENTS

2010/0212342 A1* 8/2010 Jeong ..... F25B 41/00 700/275
2014/0013614 A1* 1/2014 Choi ..... D06F 58/50 62/79
2018/0022189 A1* 1/2018 Suzuki ..... F25B 40/00 62/160

FOREIGN PATENT DOCUMENTS

KR 100713823 B1 5/2007
KR 20070099306 A * 10/2007

OTHER PUBLICATIONS

Kim, Air Conditioner and its Operating Method, Oct. 9, 2007, KR20070099306A, Whole Document (Year: 2007).*

(Continued)

*Primary Examiner* — Larry L Furdge
(74) *Attorney, Agent, or Firm* — J. Miguel Hernandez; James R. Gourley; Carstens, Allen & Gourley, LLP

(57) ABSTRACT

A control method of an air conditioner, includes: acquiring a temperature of injected vapor and a pressure of the injected vapor of a compressor of the air conditioner, to obtain a superheat degree of the injected vapor of the compressor of the air conditioner and a continuous duration of the superheat degree of the injected vapor; if the continuous duration is greater than or equal to a first preset value, and if an exhaust temperature of the compressor is less than a critical value of the exhaust temperature of the compressor within the continuous duration, controlling the compressor to be in a shutdown state, and if the continuous duration is less than the first preset value, and if the exhaust temperature of the compressor is less than the critical value of the exhaust temperature of the compressor within the continuous dura- (Continued)

tion, controlling the compressor to remain in an operating state.

17 Claims, 6 Drawing Sheets

(56) References Cited

OTHER PUBLICATIONS

Office Action—Notice of Hearing for Indian Patent Application No. 201937016510 dated Aug. 8, 2023 (4 pages).

* cited by examiner

AIR CONDITIONER, CONTROL METHOD AND CONTROL DEVICE THEREOF

CROSS REFERENCE TO RELATED APPLICATIONS

This application is a continuation-in-part of U.S. patent application Ser. No. 16/342,533, filed on Apr. 17, 2019 and published as US 2019/0242603 A1 on Aug. 8, 2019, which is a U.S. national Stage of international Application No. PCT/CN2017/103464, filed on Sep. 26, 2017 and published as WO 2018/072601 A1 on Apr. 26, 2018, designating the United States, which claims priority to China Patent Application No. 201610903627.7, filed with the Chinese Patent Office on Oct. 17, 2016. Every application, publication and patent listed in this paragraph is hereby incorporated by reference in its entirety as an example.

TECHNICAL FIELD

The present invention relates to the field of air conditioner equipment, and particularly, to an air conditioner, a control method, and a control device thereof.

BACKGROUND

The air-source heat pump absorbs the low-temperature heat energy from the air, which is transformed into high-temperature heat energy through the compressor. As a highly efficient, energy-saving and environmentally friendly heating technology, more and more air-source heat pumps are used in China. Conventional air-cooling air-source heat pumps most have a minimum environmental temperature of minus 15 degrees Celsius for heating operations. In order to broaden the heating operation range of the air-cooling air-source heat pump, Enhanced Vapor Injection technology is often used. The air-cooling heat pump using Enhanced Vapor Injection technology has a heating operation range as low as minus 25 degrees to minus 30 Celsius.

The throttling mechanism of an air-source heat pump typically is an electronic expansion valve. The electronic expansion valve is a throttling device, which controls the action of the valve needle by controlling the voltage or current applied to the expansion valve, to change the circulation area of the valve port, thereby achieving automatic regulation of flow volume. A common failure of the electronic expansion valve includes a jam, which will result in no flow or uncontrolled flow in the relevant flow path. The cause of the jam of the electronic expansion valve is usually that there are impurities in the system. The jam of the electronic expansion valve has a strong influence on the reliability of the unit. When there is no flow in the event of a jam, there will be a low-voltage protection or a high-temperature exhaust protection, and the unit can usually be protected quickly, thereby effectively protecting the compressor. When the flow is out of control (larger number of steps) in the event of a jam, the jam is usually difficult to be determined. If the unit cannot be quickly protected and operates for a long time, the compressor will be damaged, then it will be too late to find through inspection and analysis that the damage of the compressor is caused by the jam of the electronic expansion valve.

SUMMARY

The main objective of the present invention is to provide an air conditioner and a control method thereof, so as to solve the problem that the compressor in the prior art is easily damaged.

In order to realize the objective above, according to one aspect of the present invention, a control method is provided. The control method comprises following steps: acquiring a temperature of injected vapor and a pressure of the injected vapor of a compressor of the air conditioner, to obtain a superheat degree of the injected vapor of the compressor of the air conditioner and a continuous duration of the superheat degree of the injected vapor, if the continuous duration is greater than or equal to a first preset value, and if an exhaust temperature of the compressor is less than a critical value of the exhaust temperature of the compressor within the continuous duration, controlling the compressor to be in a shutdown state, and controlling the compressor to restart or to be in a shutdown protection state according to the number of shutdowns of the compressor, and if the continuous duration is less than the first preset value, and if the exhaust temperature of the compressor is less than the critical value of the exhaust temperature of the compressor within the continuous duration, controlling the compressor to remain in an operating state.

In some embodiments, the controlling the compressor to restart or to be in a shutdown protection state according to the number (N) of shutdowns of the compressor includes: determining whether the number (N) of the shutdowns of the compressor is greater than a second preset value ($N_{MAX}$), if the number (N) of the shutdowns of the compressor is less than or equal to the second preset value ($N_{MAX}$), controlling the compressor to restart, and if the number (N) of the shutdowns of the compressor is greater than the second preset value ($N_{MAX}$), controlling the compressor to be in the shutdown protection state.

In some embodiments, the second preset value $N_{MAX}$ is an integer satisfying $1 \leq N \leq 2$.

In some embodiments, the control method further includes: determining whether the exhaust temperature of the compressor is greater than or equal to the critical value of the exhaust temperature of the compressor, and if the exhaust temperature of the compressor is greater than or equal to the critical value of the exhaust temperature of the compressor, controlling the compressor to be in the shutdown protection state.

In some embodiments, the acquiring the temperature of the injected vapor and the pressure of the injected vapor of the compressor of the air conditioner, to obtain the superheat degree of the injected vapor of the compressor of the air conditioner and the continuous duration of the superheat degree of the injected vapor, includes: determining whether the superheat degree of the injected vapor is less than or equal to a superheat degree deviation, if the superheat degree of the injected vapor is less than or equal to the superheat degree deviation, the superheat degree being negative, calculating a negative-superheat degree continuous duration, and calculating the continuous duration of the superheat degree of the injected vapor to be $tc=t_N$, and if the superheat degree of the injected vapor is greater than the superheat degree deviation, the superheat degree being positive, calculating a positive-superheat degree continuous duration, and determining whether the positive-superheat degree continuous duration is less than or equal to a third preset value, if the positive-superheat degree continuous duration is less than or equal to the third preset value calculating the continuous duration of the superheat degree of the injected vapor to be $tc=t_N+t_P$, and if the positive-superheat degree continuous duration is greater than the third preset value, resetting a calculated continuous duration to obtain $tc=0$.

In some embodiments, the third preset value satisfies $0<t_{threshold}\leq 60$ s.

In some embodiments, the acquiring the temperature of the injected vapor and the pressure of the injected vapor of the compressor of the air conditioner, to obtain the superheat degree of the injected vapor of the compressor of the air conditioner and the continuous duration of the superheat degree of the injected vapor, includes: in a heating mode or in a cooling mode of the air conditioner, determining whether the superheat degree of the injected vapor is less than or equal to the superheat degree deviation, if the superheat degree of the injected vapor is less than or equal to the superheat degree deviation, the superheat degree being negative, calculating a negative-superheat degree continuous duration, and calculating the continuous duration of the superheat degree of the injected vapor to be $tc=t_N$, if the superheat degree of the injected vapor is greater than the superheat degree deviation, the superheat degree being positive, calculating a positive-superheat degree continuous duration, and determining whether the positive-superheat degree continuous duration is less than or equal to a third preset value, if the positive-superheat degree continuous duration is less than or equal to the third preset value, calculating the continuous duration of the superheat degree of the injected vapor to be $tc=t_N+t_P$, and if the positive-superheat degree continuous duration is greater than the third preset value, resetting a calculated continuous duration to obtain tc=0, and in the heating mode, and when the air conditioner performs the defrost mode, the continuous duration being reset to tc=0.

According to another aspect of the present disclosure, a disclosed control device of an air conditioner includes circuitry of an acquiring unit and circuitry of a comparing and controlling unit. The circuitry of the acquiring unit includes a first temperature sensor, a second temperature sensor, and a pressure sensor, and is configured to acquire a temperature of injected vapor and a pressure of the injected vapor of a compressor of the air conditioner, to obtain a superheat degree of the injected vapor of the compressor of the air conditioner and a continuous duration of the superheat degree of the injected vapor. The circuitry of the comparing and controlling unit is electrically connected with the circuitry of the acquiring unit, and is configured: if the continuous duration is greater than or equal to a first preset value, and if an exhaust temperature of the compressor is less than a critical value of the exhaust temperature of the compressor within the continuous duration, to control the compressor to be in a shutdown state, and to control the compressor to restart or to be in a shutdown protection state according to the number of shutdowns of the compressor, and if the continuous duration is less than the first preset value, and if the exhaust temperature of the compressor is less than the critical value of the exhaust temperature of the compressor within the continuous duration, to control the compressor to remain in an operating state.

According to another aspect of the present disclosure, an air conditioner is provided. The air conditioner includes: a compressor, a first heat exchanger, a second heat exchanger, a gas supply device, which are in communication with each other, any one of the control device of the air conditioner of the above embodiments, and a gas supply pipeline. A first end of the gas supply pipeline is in communication with an outlet end of the first heat exchanger, a second end of the gas supply pipeline is in communication with a gas supply port of the compressor, and at least part of the gas supply pipeline performs heat exchange with the gas supply device, to increase temperature of a refrigerant in the gas supply pipeline.

In some embodiments of the present disclosure, the gas supply pipeline is provided with at least one of an electronic expansion valve, a pressure sensor and a first temperature sensor.

In some embodiments of the present disclosure, a second temperature sensor is arranged in a discharge pipeline of the compressor.

In some embodiments of the present disclosure, a third temperature sensor is arranged in the gas supply pipeline; and the third temperature sensor is disposed between the electronic expansion valve and the gas supply device.

As for the technical solution of the control method of the air conditioner, the control method includes controlling a compressor of an air conditioner to be in an operating state or a shutdown state according to a superheat degree of injected vapor of the compressor and a continuous duration of superheat degree of the injected vapor, and controlling the compressor to restart or to be in a shutdown protection state according to the number of shutdown times of the compressor, so as to maintain a gas supply pipeline of the compressor. Such a method can effectively judge the working conditions of the compressor, so that the compressor can be timely maintained and be protected from being damaged for operating under severe working conditions, thereby improving the operation reliability of the compressor and the air conditioner.

DESCRIPTION OF THE DRAWINGS

The accompanying drawings constituting a part of the present application are provided to further make the present invention understood. The illustrative embodiments of the present invention and the description are used to explain the present invention, but not intended to limit the present invention. In the drawings.

DETAILED DESCRIPTION OF EMBODIMENTS

Figure 1:
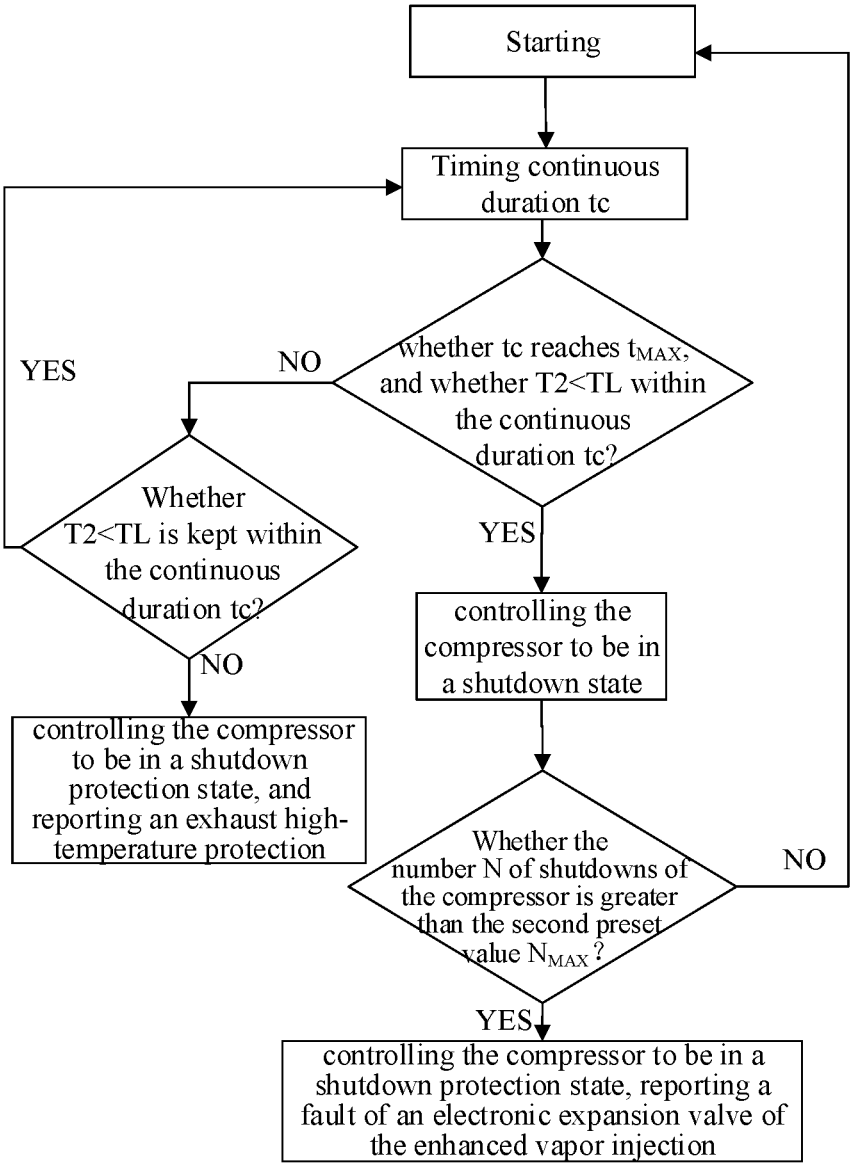
FIG. 1 is a flowchart illustrating an embodiment of a control method of an air conditioner of the present disclosure.

It should be specified that, the embodiments and the features in the embodiments of the present invention may be combined with each other when there is no conflict. The embodiments of the present invention will be described in detail with reference to the accompanying drawings.

It should be noted that, the terminology herein is used for describing the specific embodiments, but not intended to limit the illustrative embodiments of the present invention.

The singular terms herein are intended to include their plural unless specific descriptions are provided in context. It should be also understood that, the terms "include" and/or "comprise" in the description refer to including the features, steps, operations, devices, components, and/or combinations thereof.

It should be specified that the terms "first", "second", etc. in the description, the claims and the drawings in the present application are just used to distinguish similar objects, but not used to describe a specific order or an order of priority. It should be understood that such terms may be interchangeable under appropriate conditions, such that the embodiments of the present invention illustrated in the drawing or described herein can be implemented, for example, in a sequence other than the sequences illustrated or described herein. In addition, the terms "comprise", "have" and any variations thereof are intended to cover a non-exclusive inclusion. For example, a process, a method, a system, a product, or a device that includes a series of steps or units is not limited to those steps or units listed clearly, but may include other steps or units, which are not clearly listed, or which are inherent to such a process, a method, a product or a device.

For the convenience of description, terms of spatial relations such as "above", "over", "on a top surface", "upper", etc., may be used herein to describe the spatial position relationships of a device or a feature with other devices or features shown in the drawings. It should be understood that the terms of spatial relations are intended to include other different orientations in use or operation in addition to the orientation of the device described in the drawings. For example, if the device in the drawings is placed upside down, the device described as "above other devices or structures" or "over other devices or structures" will be positioned as "below other devices or structures" or "under other devices or structures". Thus, the exemplary term "above" may include both "above" and "below". The device can also be positioned in other different ways (rotating 90 degrees or at other orientations), and the corresponding explanations for the description of the spatial relations will be provided herein.

Now exemplary embodiments of the present invention will be described in detail with reference to the accompanying drawings. However, the exemplary embodiments may be implemented in different forms and should not be interpreted to limit the present invention. It should be understood that the embodiments are provided so that the disclosure of the present application will be thorough and complete, and the concepts of the exemplary embodiments will be sufficiently disclosed to those skilled in the art. In the drawings, the thicknesses of the layers and regions may be enlarged for the sake of clarity, and as the same reference numerals denote the identical devices, the description thereof is omitted.

In the related art, in order to broaden the heating operation range of the air-cooling air-source heat pump, Enhanced Vapor Injection technology is often used. The electronic expansion valve for enhanced enthalpy injection of the air-cooling heat pump system using enhanced vapor injection technology is arranged in the sub pipeline of vapor injection increasing enthalpy, which is located downstream of the condenser, and performs functions of throttling and depressurizing the refrigerant in the enhanced vapor injection loop. When the electronic expansion valve for enhanced enthalpy injection is jammed at OB or at a small number of steps, the superheat degree of the injected vapor will be a little larger, and the performance of the unit will be reduced, and the effects of lowering the exhaust temperature of the unit through increasing the injected vapor amount will be affected. The long-term operation of vapor injection will not affect the reliability of the compressor. If the exhaust high temperature protection occurs, it can prompt the operation and maintenance personnel of the unit to promptly analyze and check the cause of the failure, and the compressor will not be damaged. However, when the electronic expansion valve for enhanced enthalpy injection is jammed at a larger number of steps, the refrigerant in the enhanced vapor injection loop increases, which will cause liquid injection to run and make the superheat degree of the vapor injected to be negative.

In the related art, long-term running of the liquid injection will cause hydraulic hit in the compressor, and result in abrasion due to insufficient lubrication as a result of diluted lubricant film of the compressor. Therefore, it is necessary to timely judge the failure behavior of the electronic expansion valve for enhanced enthalpy injection when the electronic expansion valve is jammed at a larger number of steps, to timely protect the unit and shut off the compressor, to check and analyze the reason of the jam of the electronic expansion valve for enhanced enthalpy injection, and to replace the electronic expansion valve for enhanced vapor injection in time, thus no serious after-sale damage of the compressor will occur.

Figure 2:
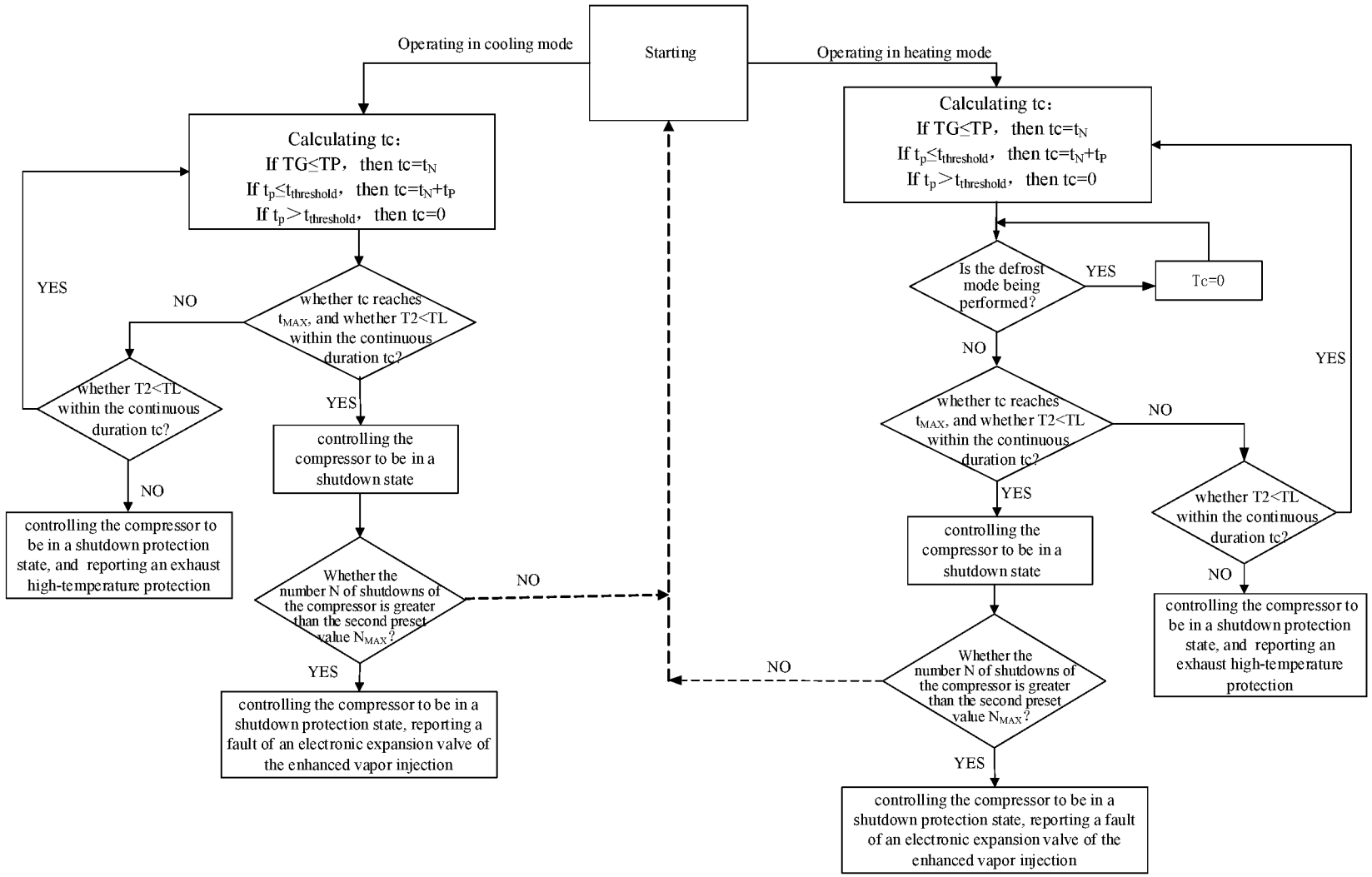
FIG. 2 is a flowchart illustrating another embodiment of the control method of the air conditioner of the present disclosure.

As shown in FIGS. 1 and 2, according to an embodiment of the present invention, a control method of the air conditioner is provided. The control method of the air conditioner includes: acquiring a temperature T1 of injected vapor and a pressure P1 of the injected vapor of the compressor of the air conditioner, to obtain a superheat degree TG of the injected vapor of the compressor of the air conditioner and a continuous duration tc of the superheat degree TG of the injected vapor; controlling the compressor of the air conditioner to be in an operating state or a shutdown state according to the superheat degree TG of the injected vapor of the compressor, the continuous duration tc of the superheat degree TG of the injected vapor, and an exhaust temperature T2 of the compressor; and if the compressor is controlled to be in a shutdown state, controlling the compressor to restart or to be in a shutdown protection state according to the number N of shutdowns of the compressor. When the compressor is controlled to be in the shutdown protection state, report a fault of an electronic expansion valve of the enhanced vapor injection and maintain a gas supply pipeline of the compressor. In the invention, it should be understood that the continuous duration (tc) of the superheat degree (TG) of the injected vapor is a time period during which the superheat degree (TG) of the injected vapor continues or lasts.

In this embodiment, such a method can effectively judge the working conditions of the compressor, so that the compressor can be timely maintained and be protected from being damaged for operating under severe working conditions, thereby improving the operation reliability of the compressor and the air conditioner.

In an embodiment of the present disclosure, the superheat degree TG of the injected vapor is obtained by the saturation temperature $TB_{(P1)}$ corresponding to the pressure P1 of the injected vapor from the temperature T1 of the injected vapor minus, that is, $TG=T1-TB_{(P1)}$.

In the present disclosure, in order to define a positive superheat degree TG and a negative superheat degree TG, a superheat degree deviation TP is introduced according to the precision of the temperature sensor measuring the superheat degree TG and actual operating conditions. When the superheat degree TG of the injected vapor is less than or equal to the superheat degree deviation TP, the superheat degree TG of the injected vapor is negative, and when the superheat degree TG of the injected vapor is greater than the superheat degree deviation TP, the superheat degree TG is positive. In general, the superheat degree deviation TP is in a range from 0.5 degree Celsius to 2 degrees Celsius.

In an embodiment of the present disclosure, as shown in FIG. 1, the controlling the compressor of the air conditioner to be in an operating state or a shutdown state according to the superheat degree TG of the injected vapor of the compressor of the air conditioner, the continuous duration tc of the superheat degree TG of the injected vapor and an exhaust temperature T2 of the compressor, specifically includes: if the continuous duration tc is greater than or equal to a first preset value $t_{MAX}$, and if the exhaust temperature T2 of the compressor is less than a critical value TL of the exhaust temperature of the compressor within the continuous duration tc, controlling the compressor to be a shutdown state, and if the continuous duration tc is less than the first preset value $t_{MAX}$, and if the exhaust temperature T2 of the compressor is less than the critical value TL of the exhaust temperature of the compressor within the continuous duration tc, controlling the compressor to remain in an operating state.

In an embodiment of the present disclosure, the controlling the compressor to restart or to be in a shutdown protection state according to the number N of shutdowns of the compressor includes following steps. It is determined whether the number N of shutdowns of the compressor is greater than or equal to a second preset value $N_{MAX}$. The compressor is controlled to restart when the number N of shutdowns of the compressor is less than or equal to the second preset value $N_{MAX}$, and the compressor is controlled to be in a shutdown protection state when the number N of shutdowns of the compressor is greater than the second preset value $N_{MAX}$. At this time, the air conditioner reports a fault of an electronic expansion valve of the enhanced vapor injection so as to maintain a gas supply pipeline of the compressor. Such a configuration can effectively avoid a false judgment, which is made under the conditions that the compressor shuts down itself occasionally under normal working conditions, and that the shutdown will not cause damage to the normal operation of the air conditioner and to the components of the compressor. Such a control method can improve the operation reliability of the air conditioner.

Further, the compressor is controlled to restart when the number N of shutdowns of the compressor is less than or equal to the second preset value $N_{MAX}$. The compressor is controlled to be in a shutdown protection state when the number N of shutdowns of the compressor is greater than the second preset value $N_{MAX}$. Such a configuration can ensure effectively detecting and controlling the working conditions of the compressor, and timely maintaining the compressor and the pipelines of the air conditioner.

In an embodiment, the second preset value $N_{MAX}$ is an integer, satisfying $1 \leq N \leq 2$. That is, when the compressor is shut down only for the second time or for the first time, it can be controlled to restart or remain in the operating state continuously.

In an embodiment of the present disclosure, if it is determined that the exhaust temperature T2 of the compressor is greater than or equal to the critical value TL of the exhaust temperature of the compressor, the compressor is controlled to be in the shutdown protection state, and an exhaust high-temperature protection is reported, thereby effectively protecting the compressor.

When the calculated continuous duration tc of the superheat degree TG of the injected vapor reaches the first preset value $t_{MAX}$, and during the continuous duration tc of the calculated superheat degree TG of the injected vapor, the exhaust temperature T2 remains less than the critical value TL of the exhaust temperature, then the compressor is controlled to be in a shutdown state, and further the compressor is controlled to restart or to be in the shutdown protection state according to the number N of the shutdowns of the compressor.

In a heating mode and in a cooling mode of the air conditioner, the control method of the air conditioner above is as shown in FIG. 2, the continuous duration tc of the superheat degree TG of the injected vapor is calculated according to three conditions as follows:

$$tc = \begin{cases} t_N, & \text{if } TG \leq TP \text{ is satisfied continuously} \\ t_N + t_P, & \text{if } TG > TP, \text{ and } t_p \leq t_{threshold} \\ 0, & \text{if } TG > TP, \text{ and } t_p > t_{threshold} \end{cases}$$

In the equation above, TG denotes the superheat degree of the injected vapor, TP denotes the offset value of the superheat degree, $t_N$ denotes a negative-superheat degree continuous duration, $t_P$ denotes a positive-superheat degree continuous duration. It is determined whether the superheat degree TG of the injected vapor is less than or equal to the superheat degree deviation TP. If the superheat degree TG of the injected vapor is less than or equal to the superheat degree deviation TP, namely, the superheat degree TG of the injected vapor is negative, then the negative-superheat degree continuous duration $t_N$, within which the superheat degree TG of the injected vapor is negative, is calculated, and the continuous duration tc is calculated to be $tc=t_N$. Specifically, to denotes the time instant when the superheat degree TG of the injected vapor begins to be less than or equal to the offset value TP of the superheat degree, and t1 denotes the time instant when the superheat degree TG of the injected vapor begins to be greater than the offset value TP of the superheat degree after the time instant t0, and it is known that t1>t0. In this case, the continuous duration tc of the superheat degree is timed from the time instant t0 when TG≤TP. If TG≤TP is kept till the time instant t1, then the negative-superheat degree continuous duration $t_N=(t1-t0)$ is included into the continuous duration tc, namely the continuous duration $tc=t_N$. In the invention, it should be understood that the negative-superheat degree continuous duration $t_N$ is a time period during which the negative superheat degree continues or lasts, and that the positive-superheat degree continuous duration is a time period during which the positive superheat degree continues or lasts.

In the equation above, if TG>TP is satisfied since the time instant t1, and if a partial continuous duration in which TG>TP is satisfied continuously, namely the positive-superheat degree continuous duration $t_P$, is less than or equal to the third preset $t_{threshold}$, then the positive-superheat degree continuous duration $t_P$ is included into the continuous duration tc, namely, $tc=t_N+t_P$. The method of the present disclosure ensures that the compressor of the air conditioner can run effectively, thereby avoiding false judgement made in the case that the superheat degree TG of the injected vapor is greater than the offset value TP of the superheat degree within a short time due to different operation conditions.

In the embodiment of the present disclosure, the third preset value $t_{threshold}$ satisfies that $0<t_{threshold}\leq 60$ s. In some embodiments, $t_{threshold}$–60 s.

In the equation above, if TG>TP is satisfied since the time instant t1, and if the partial continuous duration, in which TG>TP is satisfied continuously, namely the positive-superheat degree continuous duration $t_P$, is greater than the third preset value $t_{threshold}$, then reset the calculated continuous duration tc, namely tc=0, and the continuous duration tc is timed again from a next time instant when TG≤TP; and afterwards, the continuous duration tc is calculated according to the above method.

In the heating mode, when the air conditioner performs the defrost mode, the continuous duration tc is reset to zero, and the reset continuous duration tc is timed again from the time instant when the superheat degree TG of the injected vapor is less than or equal to the offset value TP of the superheat degree.

In some embodiments, when the compressor is in the shutdown protection state, maintenance on the electronic expansion valve disposed in the gas supply pipeline of the compressor is performed, which can improve the reliability of gas supply in the pipeline of the compressor, thereby effectively improving the compression performance of the compressor.

Figure 3:
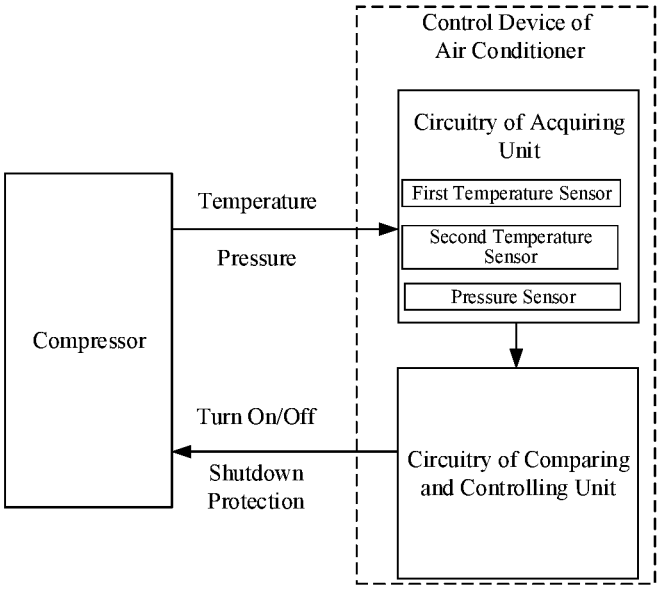
FIG. 3 is a schematic view illustrating an embodiment of a control device of an air conditioner of the present disclosure.

According to another aspect of the present disclosure, a control device of an air conditioner is provided. As shown in FIG. 3, the air conditioner includes circuitry of an acquiring unit, and circuitry of a comparing and controlling unit. The circuitry of the acquiring unit includes a first temperature sensor, a second temperature sensor, and a pressure sensor, and is configured to acquire a temperature T1 of injected vapor and a pressure P1 of the injected vapor of a compressor of the air conditioner, to obtain a superheat degree TG of the injected vapor of the compressor of the air conditioner and a continuous duration tc of the superheat degree TG of the injected vapor. The circuitry of the comparing and controlling unit is electrically connected with the circuitry of the acquiring unit, and is configured to, if the continuous duration tc is greater than or equal to a first preset value $t_{MAX}$, and if an exhaust temperature T2 of the compressor is less than a critical value TL of the exhaust temperature of the compressor within the continuous duration tc, control the compressor to be in a shutdown state, and control the compressor to restart or to be in a shutdown protection state according to the number N of shutdowns of the compressor. The circuitry of the acquiring unit is configured to, if the continuous duration tc is less than the first preset value $t_{MAX}$, and if the exhaust temperature T2 of the compressor is less than the critical value TL of the exhaust temperature of the compressor within the continuous duration tc, control the compressor to remain in an operating state.

In an embodiment of the present disclosure, the circuitry of the comparing and controlling unit is further configured to determine whether the number N of the shutdowns of the compressor is greater than a second preset value $N_{MAX}$, if the number N of the shutdowns of the compressor is less than or equal to the second preset value $N_{MAX}$, control the compressor to restart, and if the number N of the shutdowns of the compressor is greater than the second preset value $N_{MAX}$, control the compressor to be in a shutdown protection state.

In an embodiment of the present disclosure, the circuitry of the comparing and controlling unit is further configured to determine whether the exhaust temperature T2 of the compressor is greater than or equal to the critical value TL of the exhaust temperature of the compressor, and if the exhaust temperature T2 of the compressor is greater than or equal to the critical value TL of the exhaust temperature of the compressor, control the compressor to be in the shutdown protection state.

In an embodiment of the present disclosure, the circuitry of the acquiring unit is further configured to determine whether the superheat degree TG of the injected vapor is less than or equal to the superheat degree deviation TP, and if the superheat degree TG of the injected vapor is less than or equal to the superheat degree deviation TP, the superheat degree TG is negative, the circuitry of the acquiring unit is further configured to calculate a negative-superheat degree continuous duration $t_N$, and calculate the continuous duration tc of the superheat degree TG of the injected vapor to be $tc=t_N$. The circuitry of the acquiring unit is further configured to, if the superheat degree TG of the injected vapor is greater than the superheat degree deviation TP, and the superheat degree TG is positive, calculate a positive-superheat degree continuous duration $t_P$, and determine whether the positive-superheat degree continuous duration $t_P$ is less than or equal to a third preset value $t_{threshold}$, and if the positive-superheat degree continuous duration $t_P$ is less than or equal to a third preset value $t_{threshold}$, calculate the continuous duration tc of the superheat degree TG of the injected vapor to be $tc=t_N+t_P$, and if the positive-superheat degree continuous duration $t_P$ is greater than the third preset value $t_{threshold}$, reset the calculated continuous duration tc to obtain tc=0, the heating mode, and when the air conditioner performs the defrost mode, reset the continuous duration to be tc=0.

In an embodiment of the present disclosure, the circuitry of the acquiring unit is further configured to, in a heating mode or in a cooling mode of the air conditioner, determine whether the superheat degree TG of the injected vapor is less than or equal to the superheat degree deviation TP, and if the superheat degree TG of the injected vapor is less than or equal to the superheat degree deviation TP, and the superheat degree TG is negative, calculate a negative-superheat degree continuous duration ($t_N$), and calculate the continuous duration tc of the superheat degree TG of the injected vapor to be $tc=t_N$, and if the superheat degree TG of the injected vapor is greater than the superheat degree deviation TP, and the superheat degree TG is positive, calculate a positive-superheat degree continuous duration $t_P$, and determine whether the positive-superheat degree continuous duration $t_P$ is less than or equal to a third preset value $t_{threshold}$. The circuitry of the acquiring unit is further configured to, if the positive-superheat degree continuous duration $t_P$ is less than or equal to a third preset value $t_{threshold}$, calculate the continuous duration tc of the superheat degree TG of the injected vapor to be $tc=t_N+t_P$, and if the positive-superheat degree continuous duration $t_P$ is greater than the third preset value threshold, reset the calculated continuous duration tc to obtain tc=0.

Figure 4:
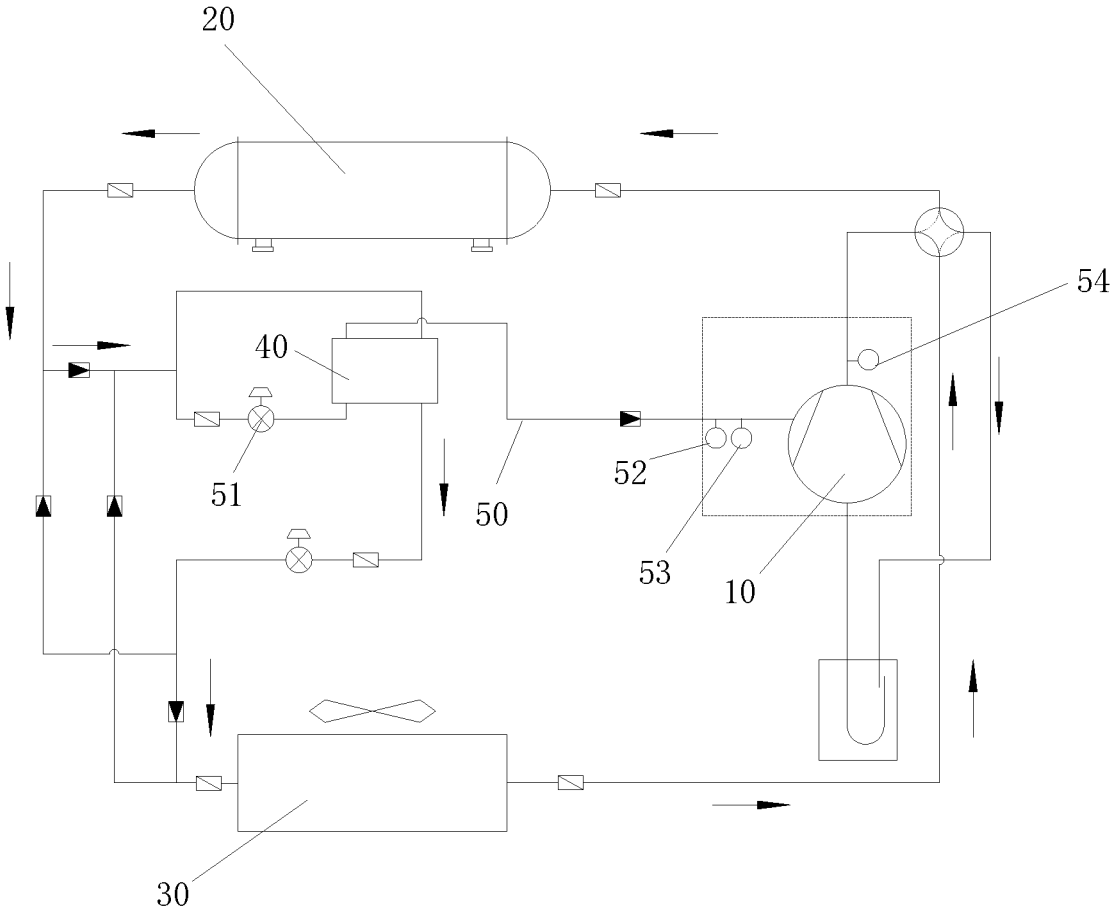
FIG. 4 is a schematic view illustrating an embodiment of an air conditioner in a heating mode according to the present disclosure.
Figure 5:
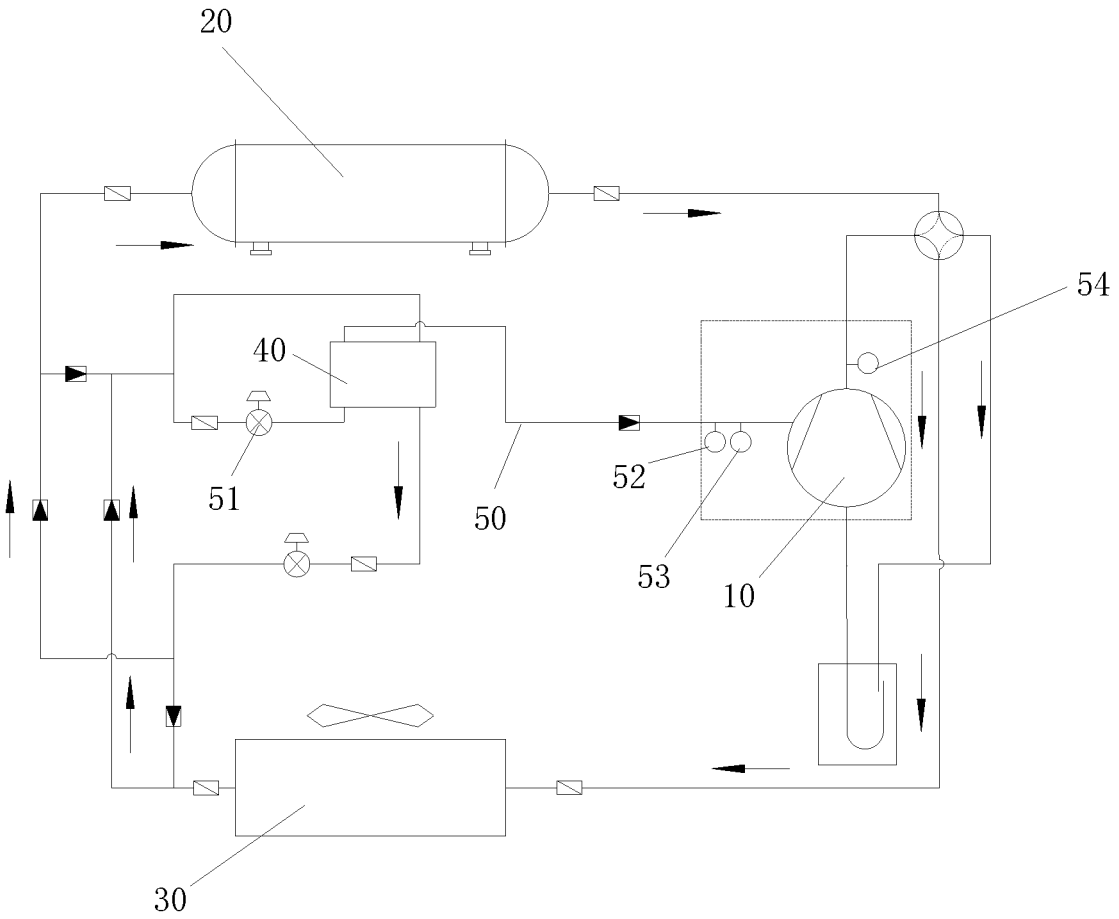
FIG. 5 is a schematic view illustrating an embodiment of the air conditioner in a cooling mode according to the present disclosure.

According to another aspect of the present disclosure, an air conditioner is provided. The air conditioner includes the control device of the air conditioner in the above embodiment. As shown in FIGS. 4 and 5, the air conditioner further includes a compressor 10, a first heat exchanger 20, a second heat exchanger 30 and a gas supply device 40, which are in communication with each other. The first end of the gas supply pipeline 50 is in communication with the outlet end of the first heat exchanger 20, and the second end of the gas supply pipeline 50 is in communication with the gas supply port of the compressor 10, and at least part of the gas supply pipeline 50 performs heat exchange with the gas supply device 40, to increase the temperature of the refrigerant in the gas supply pipeline 50. The operational reliability and the service life of the air conditioner can effectively be improved.

The gas supply pipeline 50 is provided with an electronic expansion valve 51, a pressure sensor 52 and a first temperature sensor 53. Wherein, the electronic expansion valve 51 is configured to control the gas supply opening in the gas supply pipeline 50; the pressure sensor 52 is configured to detect the pressure in the gas supply pipeline 50; and the first temperature sensor 53 is configured to detect the temperature in the gas supply pipeline 50. The superheat degree TG of the injected vapor of the compressor is calculated according to a conventional computational method.

In an embodiment of the present disclosure, in order to improve the accuracy of the calculated result, a second temperature sensor 54 is further arranged in the discharge pipeline of the compressor 10 to detect the exhaust temperature T2 at the discharge pipeline of the compressor. The nearer the second temperature sensor 54 is to the gas vent of the compressor, the more accurate the measurement is.

Figure 6:
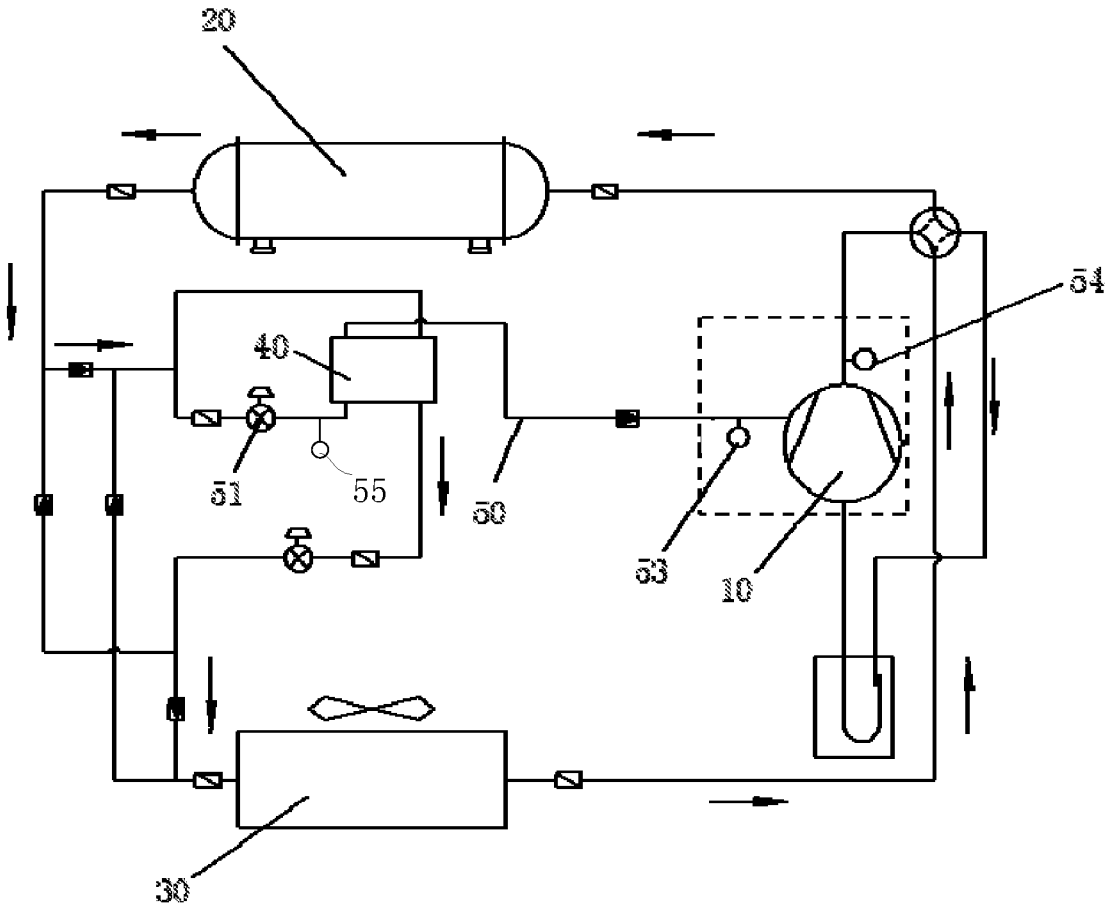
FIG. 6 is a schematic view illustrating another embodiment of the air conditioner in a heating mode according to the present disclosure.
Figure 7:
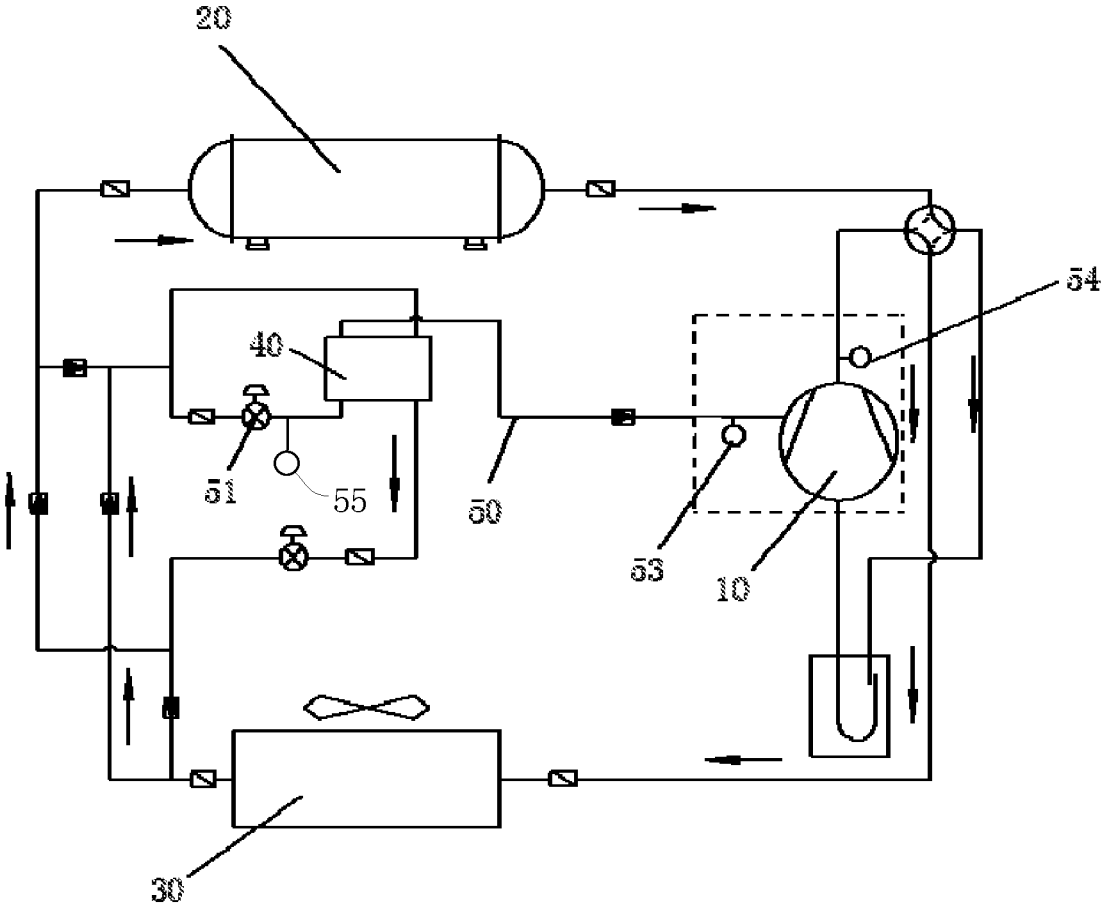
FIG. 7 is a schematic view illustrating another embodiment of the air conditioner in a cooling mode according to the present disclosure.

As shown in FIGS. 6 and 7, in an embodiment of the present disclosure, the gas supply pipeline 50 may not be provided with the pressure sensor 52, and alternatively, a third temperature sensor 55 is arranged in the gas supply pipeline 50. The third temperature sensor 55 is disposed between the electronic expansion valve 51 and the gas supply device 40.

A temperature sensor for detecting a temperature T3, namely the third temperature sensor 55, is disposed in the pipeline entering the plate heat exchanger namely the gas supply device 40. The temperature sensor for detecting a temperature T1, namely the first temperature sensor 53, is arranged at the outlet of the plate heat exchanger and before the gas supply opening of the compressor. The temperatures detected by the third temperature sensor 55 and the first temperature sensor 53 determine the conditions of liquid injection, and at this time the superheat degree TG=(T1−T3) (usually, the superheat degree TG is controlled to be 3 degrees Celsius-5 degrees Celsius). The judgment method, which determines the state of the refrigerant of the enhanced vapor injection according to the temperature difference between the gas supply pipeline 50 entering and the gas supply pipeline 50 leaving the heat exchanger in the enhanced vapor injection loop, is applicable for a compressor system which is more resistant to the liquid injection.

In an embodiment of the present disclosure, in the enhanced vapor Injection system shown in FIG. 4, whose throttling device is an electronic expansion valve, the first temperature sensor 53 for detecting a temperature T1 of the injected vapor and the pressure sensor 52 for detecting a pressure P1 of the injected vapor are disposed between the outlet of the gas supply device 40 and the inlet of the compressor, and a second temperature sensor 54 for detecting an exhaust temperature T2 is disposed in the discharge pipe at the compressor outlet. The superheat degree TG of the injected vapor is the difference between the temperature T1 of the injected vapor and the saturation temperature $TB_{(P1)}$ corresponding to the pressure P1 of the injected vapor, that is, $TG=T1-TB_{(P1)}$.

The zero-degree Celsius offset value of the superheat degree is TP, and the value is from 0.5 degree Celsius to 2 degrees Celsius, which is based on the accuracy of the first temperature sensor 53 and the actual situations. The critical value of the exhaust temperature is TL. When the exhaust temperature T2 is too high, it can be reduced by increasing the vapor injection amount. However, the reduced exhaust temperature should not be lower than the critical value TL of the exhaust temperature T2. The critical value TL of the exhaust temperature is determined by the compressor type or recommended by the compressor manufacturer, and it is usually greater than 90 degrees Celsius.

The continuous duration of the superheat degree TG of the injected vapor is tc. The first preset value of the continuous duration tc of the superheat degree TG of the injected vapor is $t_{MAX}$, which is matched and obtained through experimentation. In some embodiments, $t_{MAX}$=20 min.

When the air conditioner operates normally, the control device controls the electronic expansion valve according to the optimum superheat degree (from 3 degrees Celsius to 8 degrees Celsius in this embodiment) of the injected vapor, and the steps of the electronic expansion valve for the enhanced vapor injection is continuously adjusted, so as to maintain the optimum superheat degree of the injected vapor. When the electronic expansion valve for the vapor injection is normal, the superheat degree TG of the injected vapor can be quickly controlled to be within the optimal range, and usually, the adjustment time is less than 15 minutes. At this time, the enhanced vapor injection effect is optimum. When the electronic expansion valve for the vapor injection is jammed at a larger number of steps, liquid injection will occur. At this time, the failure behavior is judged by the following processing method. Specifically, after the compressor of the air conditioner starts running, if the continuous duration tc is equal to $t_{MAX}$, and the exhaust temperature T2 is maintained to be less than TL during this process (within the continuous duration tc), then shut down the compressor of the air conditioner immediately. If the second preset value $N_{MAX}$=2, after each of the first two shutdowns of the compressor, the compressor is restored automatically to operate, and after the compressor is shut down for the third time, the compressor of the air conditioner is completely locked, and the failure of the electronic expansion valve for enhanced vapor injection is reported to warn the operation and maintenance personnel of timely checking and analyzing, timely replacing the electronic expansion valve for the enhanced vapor injection, so as to protect the compressor. There are basically no false alarms in this control method, the specific flowchart of which is shown in FIG. 1.

The calculation method of the continuous duration tc of the superheat degree TG of the injected vapor is as follows: t0 denotes the time instant when the superheat degree TG of the injected vapor begins to be less than or equal to the offset value TP of the superheat degree, and t1 denotes the time instant when the superheat degree TG of the injected vapor begins to be greater than the offset value TP of the superheat degree after the time instant t0, it is known that t1>t0. The air conditioner operates in the cooling mode, and the compressor starts. Start to calculate the continuous duration tc after the electronic expansion valve for enhanced vapor injection is turned on, and the continuous duration tc is timed from the time instant t0 when TG≤TP; if TG≤TP is kept till the time instant t1, then the negative-superheat degree continuous duration $t_N$=(t1−t0) is included into the continuous duration tc, namely the continuous duration $tc=t_N$; if TG>TP is satisfied since the time instant t1, and if the partial continuous duration in which TG>TP is satisfied continuously, namely the positive-superheat degree continuous duration $t_P$, is less than or equal to the third preset $t_{threshold}$, then the positive-superheat degree continuous duration $t_P$ is included in the continuous duration tc, namely, $tc=t_N+t_P$. if TG>TP is satisfied since the time instant t1, and if the partial continuous duration, in which TG>TP is satisfied continuously, namely the positive-superheat degree continuous duration $t_P$, is greater than the third preset $t_{threshold}$, then reset the calculated continuous duration tc, and the continuous duration tc is timed from a next time instant t0 when TG≤TP again, and afterwards, the continuous duration tc is calculated according to the above method. In an embodiment, the third preset $t_{threshold}$=60 s.

The air conditioner operates in the heating mode, and the compressor starts. Start to calculate the continuous duration tc after the electronic expansion valve for enhanced vapor injection is turned on, and the continuous duration tc is timed from the time instant t0 when TG≤TP. If TG≤TP is kept till the time instant t1, then the negative-superheat degree continuous duration $t_N$=(t1−t0) is included into the continuous duration tc, namely tc=$t_N$. If TG>TP is satisfied since the time instant t1, and if the partial continuous duration in which TG>TP is satisfied continuously, namely the positive-superheat degree continuous duration $t_P$, is less than or equal to the third preset $t_{threshold}$, then the positive-superheat degree continuous duration $t_P$ is included into the continuous duration tc of the superheat degree, namely, tc=$t_N$+$t_P$. If TG>TP is satisfied since the time instant t1, and if the partial continuous duration in which TG>TP, is greater than the third preset value $t_{threshold}$, then reset the calculated continuous duration tc, and the continuous duration tc is timed again from a next time instant t0 when TG≤TP. Afterwards, the continuous duration tc is calculated according to the above method. If the air conditioner operating in the heating mode enters the defrosting mode, the calculated continuous duration tc is reset; if the air conditioner operating in the defrosting mode enters the heating mode, the continuous duration tc is timed again from the time instant t0 when TG≤TP, and then calculate it according to the above method. In some embodiments, the third preset value $t_{threshold}$=60 s. For the details, please refer to the flowchart of FIG. 2.

Accurately, fast and timely judge the failure of the electronic expansion valve for enhanced vapor injection when it is jammed at a larger number of steps; timely shut down the compressor of the system, whose electronic expansion valve for enhanced vapor injection has a failure; warn the operation and maintenance personnel of timely analyzing and checking, and timely replacing the electronic expansion valve for enhanced vapor injection, so as to protect the compressor from severe damage. Reduce economic losses and avoid severe after-sale failure of the compressor damage.

In another aspect of the present disclosure, a computer device is provided. The computer device includes a memory and a processor. A computer program is stored in the memory, and when executing the computer program, the processor performs steps of the control method of the air conditioner above. In an embodiment of the present disclosure, the processor of the computer may also be called a computer chip, and may be a PLC controller, a DSP controller, etc.

According to another aspect of the present disclosure, a non-transitory computer-readable storage medium is disclosed. The non-transitory computer-readable storage medium stores a computer program. When performed by a processor, the computer program executes the steps of the methods of the corresponding embodiments. Those skilled in the art should understand that the embodiments of the present disclosure may be provided as methods, devices, or computer program products. Thus, the present disclosure may use the form of full hardware embodiments, full software embodiments, or embodiments combining software and hardware. Furthermore, the present disclosure may use the form of computer program products to be implemented on one or more non-transitory computer-executable storage media (including but not limited to disk storage, a CD-ROM, an optical storage, etc.) including computer-executable program codes.

The present disclosure is described with reference to flowcharts and/or block diagrams of the methods, the equipment (systems) and the computer program products according to the embodiments of this disclosure. It should be understood that each process and/or block in a flowchart and/or block diagrams as well as the combination of processes and/or blocks in the flowchart and/or the block diagrams may be implemented by computer program instructions. Such computer program instructions may be provided to a processor of a general computer, a special computer, an embedded processor, or any other programmable data processing device to produce a machine, so that the instructions executed by the processor of the computer or any other programmable data processing device produce a device to perform a function specified in one or more processes of the flow chart and/or one or more blocks of the block diagrams.

These computer program instructions may also be stored in a computer-readable memory capable of directing a computer or any other programmable data processing device to work in a particular manner, so that the instructions stored in such computer-readable memory produce a manufactured article including an instructional device that implements a function specified in one or more processes in the flowchart and/or specified in one or more blocks in the block diagrams.

These computer program instructions may also be loaded onto a computer or any other programmable data processing device, so that a series of operational steps are performed on the computer or on any other programmable device to produce the computer-implemented processing, so that the instructions performed on the computer or on any other programmable device provide steps for achieving a function specified in one or more processes of the flowchart and/or specified in one or more blocks of the block diagrams.

What described above are some embodiments of the present invention, and they are not intended to limit the present invention. It will be understood by those skilled in the art that various modifications and improvements can be made. All these modifications, equivalent substitution and improvements made without departing from the sprits and principles of the present disclosure, are within the protection scope of the present invention.

What is claimed is:

1. A control method of an air conditioner, comprising:

acquiring a temperature (T1) of injected vapor and a pressure (P1) of the injected vapor of a compressor of the air conditioner, to obtain a superheat degree (TG) of the injected vapor of the compressor of the air conditioner and a continuous duration (tc) of the superheat degree (TG) of the injected vapor; the continuous duration (tc) of the superheat degree (TG) of the injected vapor being a time period during which the superheat degree (TG) of the injected vapor continues;

if the continuous duration (tc) is greater than or equal to a first preset value ($t_{MAX}$), and if an exhaust temperature (T2) of the compressor is less than a critical value (TL) of the exhaust temperature of the compressor within the continuous duration (tc), controlling the compressor to be in a shutdown state, and controlling the compressor to restart or to be in a shutdown protection state according to the number (N) of shutdowns of the compressor; and if the continuous duration (tc) is less than the first preset value ($t_{MAX}$), and if the exhaust temperature (T2) of the compressor is less than the critical value (TL) of the exhaust temperature of the compressor within the continuous duration (tc), controlling the compressor to remain in an operating state.

2. The control method according to claim 1, wherein, the controlling the compressor to restart or to be in a shutdown protection state according to the number (N) of shutdowns of the compressor comprises:

determining whether the number (N) of the shutdowns of the compressor is greater than a second preset value ($N_{MAX}$);

if the number (N) of the shutdowns of the compressor is less than or equal to the second preset value ($N_{MAX}$), controlling the compressor to restart; and if the number (N) of the shutdowns of the compressor is greater than the second preset value ($N_{MAX}$), controlling the compressor to be in the shutdown protection state.

3. The control method according to claim 2, wherein, the second preset value ($N_{MAX}$) is an integer satisfying $1 \leq N \leq 2$.

4. The control method according to claim 1, further comprising:

determining whether the exhaust temperature (T2) of the compressor is greater than or equal to the critical value (TL) of the exhaust temperature of the compressor;

if the exhaust temperature (T2) of the compressor is greater than or equal to the critical value (TL) of the exhaust temperature of the compressor, controlling the compressor to be in the shutdown protection state.

5. The control method according to claim 1, wherein the acquiring the temperature (T1) of the injected vapor and the pressure (P1) of the injected vapor of the compressor of the air conditioner, to obtain the superheat degree (TG) of the injected vapor of the compressor of the air conditioner and the continuous duration (tc) of the superheat degree (TG) of the injected vapor, comprises:

determining whether the superheat degree (TG) of the injected vapor is less than or equal to a superheat degree deviation (TP);

if the superheat degree (TG) of the injected vapor is less than or equal to the superheat degree deviation (TP), the superheat degree (TG) being negative, calculating a negative-superheat degree continuous duration ($t_N$), and calculating the continuous duration (tc) of the superheat degree (TG) of the injected vapor to be $tc=t_N$; the negative-superheat degree continuous duration ($t_N$) being a time period during which the negative superheat degree continues; and if the superheat degree (TG) of the injected vapor is greater than the superheat degree deviation (TP), the superheat degree (TG) being positive, calculating a positive-superheat degree continuous duration ($t_P$), and determining whether the positive-superheat degree continuous duration ($t_P$) is less than or equal to a third preset value ($t_{threshold}$); the positive-superheat degree continuous duration ($t_P$) being a time period during which the positive superheat degree continues;

if the positive-superheat degree continuous duration ($t_P$) is less than or equal to the third preset value ($t_{threshold}$) calculating the continuous duration (tc) of the superheat degree (TG) of the injected vapor to be $tc=t_N+t_P$; and if the positive-superheat degree continuous duration ($t_P$) is greater than the third preset value ($t_{threshold}$), resetting a calculated continuous duration (tc) to obtain tc=0.

6. The control method according to claim 5, wherein, the third preset value ($t_{threshold}$) satisfies $0<t_{threshold}\leq 60$ s.

7. The control method according to claim 1, wherein, the acquiring the temperature (T1) of the injected vapor and the pressure (P1) of the injected vapor of the compressor of the air conditioner, to obtain the superheat degree (TG) of the injected vapor of the compressor of the air conditioner and the continuous duration (tc) of the superheat degree (TG) of the injected vapor, comprises:

in a heating mode or in a cooling mode of the air conditioner, determining whether the superheat degree (TG) of the injected vapor is less than or equal to the superheat degree deviation (TP);

if the superheat degree (TG) of the injected vapor is less than or equal to the superheat degree deviation (TP), the superheat degree (TG) being negative, calculating a negative-superheat degree continuous duration ($t_N$), and calculating the continuous duration (tc) of the superheat degree (TG) of the injected vapor to be $tc=t_N$; the negative-superheat degree continuous duration ($t_N$) being a time period during which the negative superheat degree continues;

if the superheat degree (TG) of the injected vapor is greater than the superheat degree deviation (TP), the superheat degree (TG) being positive, calculating a positive-superheat degree continuous duration ($t_P$), and determining whether the positive-superheat degree continuous duration ($t_P$) is less than or equal to a third preset value ($t_{threshold}$); the positive-superheat degree continuous duration ($t_P$) being a time period during which the positive superheat degree continues;

if the positive-superheat degree continuous duration ($t_P$) is less than or equal to the third preset value ($t_{threshold}$), calculating the continuous duration (tc) of the superheat degree (TG) of the injected vapor to be $tc=t_N+t_P$; and if the positive-superheat degree continuous duration ($t_P$) is greater than the third preset value ($t_{threshold}$), resetting a calculated continuous duration (tc) to obtain tc=0; and in the heating mode, and when the air conditioner performs the defrost mode, the continuous duration being reset to tc=0.

8. A computer device, comprising a memory and a processor, wherein, a computer program is stored in the memory, and when executing the computer program, the processor performs steps of the control method of claim 1.

9. A non-transitory computer-readable storage medium, wherein a computer program is stored in the storage medium, and when executed by a processor, the computer program performs steps of the control method of claim 1.

10. A control device of an air conditioner, comprising:

circuitry of an acquiring unit, comprising a first temperature sensor, a second temperature sensor, and a pressure sensor, and configured to acquire a temperature (T1) of injected vapor and a pressure (P1) of the injected vapor of a compressor of the air conditioner, to obtain a superheat degree (TG) of the injected vapor of the compressor of the air conditioner and a continuous duration (tc) of the superheat degree (TG) of the injected vapor, wherein the continuous duration (tc) of the superheat degree (TG) of the injected vapor is a time period during which the superheat degree (TG) of the injected vapor continues; and circuitry of a comparing and controlling unit, electrically connected with the circuitry of the acquiring unit, and configured to: if the continuous duration (tc) is greater than or equal to a first preset value ($t_{MAX}$), and if an exhaust temperature (T2) of the compressor is less than a critical value (TL) of the exhaust temperature of the compressor within the continuous duration (tc), control the compressor to be in a shutdown state, and control the compressor to restart or to be in a shutdown protection state according to the number (N) of shutdowns of the compressor; and if the continuous duration (tc) is less than the first preset value ($t_{MAX}$), and if the exhaust temperature (T2) of the compressor is less than the critical value (TL) of the exhaust temperature of the compressor within the continuous duration (tc), control the compressor to remain in an operating state.

11. The control device of the air conditioner according to claim 10, wherein, the circuitry of the comparing and controlling unit is further configured to: determine whether the number (N) of the shutdowns of the compressor is greater than a second preset value ($N_{MAX}$); if the number (N) of the shutdowns of the compressor is less than or equal to the second preset value ($N_{MAX}$), control the compressor to restart; and if the number (N) of the shutdowns of the compressor is greater than the second preset value ($N_{MAX}$), control the compressor to be in the shutdown protection state.

12. The control device of the air conditioner according to claim 10, wherein, the circuitry of the comparing and controlling unit is further configured to: determine whether the exhaust temperature (T2) of the compressor is greater than or equal to the critical value (TL) of the exhaust temperature of the compressor; and if the exhaust temperature (T2) of the compressor is greater than or equal to the critical value (TL) of the exhaust temperature of the compressor, control the compressor to be in the shutdown protection state.

13. The control device of the air conditioner according to claim 10, wherein, the circuitry of the acquiring unit is further configured to:

determine whether the superheat degree (TG) of the injected vapor is less than or equal to the superheat degree deviation (TP);

if the superheat degree (TG) of the injected vapor is less than or equal to the superheat degree deviation (TP), the superheat degree (TG) is negative, calculate a negative-superheat degree continuous duration ($t_N$), and calculate the continuous duration (tc) of the superheat degree (TG) of the injected vapor to be $tc=t_N$, wherein the negative-superheat degree continuous duration ($t_P$) is a time period during which the negative superheat degree continues; and if the superheat degree (TG) of the injected vapor is greater than the superheat degree deviation (TP), the superheat degree (TG) is positive, calculate a positive-superheat degree continuous duration ($t_P$), and determine whether the positive-superheat degree continuous duration ($t_P$) is less than or equal to a third preset value ($t_{threshold}$), wherein the positive-superheat degree continuous duration ($t_P$) is a time period during which the positive superheat degree continues;

if the positive-superheat degree continuous duration ($t_P$) is less than or equal to the third preset value ($t_{threshold}$), calculate the continuous duration (tc) of the superheat degree (TG) of the injected vapor to be $tc=t_N+t_P$; and if the positive-superheat degree continuous duration ($t_P$) is greater than the third preset value ($t_{threshold}$), reset a calculated continuous duration (tc) to obtain tc=0.

14. The control device of the air conditioner according to claim 10, wherein, the circuitry of the acquiring unit is further configured to: in a heating mode or in a cooling mode of the air conditioner, determine whether the superheat degree (TG) of the injected vapor is less than or equal to the superheat degree deviation (TP);

if the superheat degree (TG) of the injected vapor is less than or equal to the superheat degree deviation (TP), the superheat degree (TG) is negative, calculate a negative-superheat degree continuous duration ($t_N$), and calculate the continuous duration (tc) of the superheat degree (TG) of the injected vapor to be $tc=t_N$, wherein the negative-superheat degree continuous duration ($t_N$) is a time period during which the negative superheat degree continues;

if the superheat degree (TG) of the injected vapor is greater than the superheat degree deviation (TP), the superheat degree (TG) is positive, calculate a positive-superheat degree continuous duration ($t_P$), and determine whether the positive-superheat degree continuous duration ($t_P$) is less than or equal to a third preset value ($t_{threshold}$), wherein the positive-superheat degree continuous duration ($t_P$) is a time period during which the positive superheat degree continues;

if the positive-superheat degree continuous duration ($t_P$) is less than or equal to the third preset value ($t_{threshold}$), calculate the continuous duration (tc) of the superheat degree (TG) of the injected vapor to be $tc=t_N+t_P$; and if the positive-superheat degree continuous duration ($t_P$) is greater than the third preset value ($t_{threshold}$), reset a calculated continuous duration (tc) to obtain tc=0; and in the heating mode, and when the air conditioner performs the defrost mode, reset the continuous duration to be tc=0.

15. An air conditioner, comprising:

a compressor, a first heat exchanger, a second heat exchanger, a gas supply device, which are in communication with each other;

the control device of the air conditioner of claim 10; and a gas supply pipeline, a first end of the gas supply pipeline being in communication with an outlet end of the first heat exchanger, a second end of the gas supply pipeline being in communication with a gas supply port of the compressor, and at least part of the gas supply pipeline performing heat exchange with the gas supply device to increase temperature of a refrigerant in the gas supply pipeline.

16. The air conditioner according to claim 15, wherein, the gas supply pipeline is provided with at least one of an electronic expansion valve, a pressure sensor and a first temperature sensor.

17. The air conditioner according to claim 15, wherein, a second temperature sensor is arranged in a discharge pipeline of the compressor.

* * * * *